US005925234A

United States Patent [19]

Morel et al.

[11] Patent Number: 5,925,234

[45] Date of Patent: Jul. 20, 1999

[54] PROCESS FOR THE PRODUCTION OF AN INTERNAL COMBUSTION ENGINE FUEL BASE BY HYDROTREATMENT AND EXTRACTION, AND THE PRODUCT THEREFROM

[75] Inventors: Frederic Morel, Sainte Foy Les Lyon; Massimo Zuliani, Neuilly Sur Seine; Paul Mikitenko, Noisy le Roy; Marc Boulet, Gif Sur Yvette; Roben Loutaty, Le Havre; Jean Claude Company, Mareil Marly, all of France

[73] Assignee: Institut Francais Du Pétrole and Total Raffinage Distribution, France

[21] Appl. No.: 08/747,739

[22] Filed: Nov. 12, 1996

Related U.S. Application Data

[63] Continuation of application No. 08/365,440, Dec. 28, 1994, abandoned.

[30] Foreign Application Priority Data

Dec. 28, 1993 [FR] France ..... 93 15857

[51] Int. Cl.[6] ..... C10G 67/04

[52] U.S. Cl. ..... 208/96; 208/143; 208/212; 208/302; 208/80

[58] Field of Search ..... 208/96, 143, 212, 208/302, 80

[56] References Cited

U.S. PATENT DOCUMENTS 4,990,242 2/1991 Louie et al. ..... 208/80
5,059,303 10/1991 Taylor et al. ..... 208/96

*Primary Examiner*—Bekir L. Yildirim
*Attorney, Agent, or Firm*—Millen, White, Zelano & Branigan P.C.

[57] ABSTRACT

The invention concerns a petroleum product and a process for the production of a petroleum product which can form part of a blend for an internal combustion engine fuel, the process comprising a) hydrotreating a hydrocarbon feedstock at a partial pressure of hydrogen at the reactor outlet of about 0.5 MPa to about 6 MPa, b) separating a product (P) from step a) into a product (P1) with a final boiling point of about 300° C. and a product (P2) with an initial boiling point greater than the final boiling point of product (P1), c) performing a liquid-liquid extraction with a solvent (S1), to produce an extract (E1) and a raffinate (R1) from product (P2), d) recovering solvent (S1) from raffinate (R1) to produce a product (Q1), depleted in solvent (S1), which has improved qualities and contains less than 500 ppm by weight of sulphur.

17 Claims, 1 Drawing Sheet

PROCESS FOR THE PRODUCTION OF AN INTERNAL COMBUSTION ENGINE FUEL BASE BY HYDROTREATMENT AND EXTRACTION, AND THE PRODUCT THEREFROM

This application is a continuation of application Ser. No. 08/365,440, filed Dec. 28, 1994, now abandoned.

BACKGROUND OF THE INVENTION

The invention concerns a petroleum product and a process for the production of said petroleum product which can form part of a blend for an internal combustion engine fuel, and to the product obtained by the process. Gas oils currently on the market, either as internal combustion engine fuels or as a domestic fuel, are most often refined products which contain about 0.3% of sulphur (expressed as weight of sulphur) They are normally produced by hydrofining a feedstock which may be a straight run distillate of a crude petroleum or from a particular crude petroleum treatment (for example pyrolysis or distillation followed by pyrolysis of the fraction recovered during distillation, or thermal or catalytic cracking), generally containing at least 0.8% by weight of sulphur.

The prior art is illustrated in U.S. Pat. No. 5,059,303 which describes a process for stabilising hydrocarbon fractions (syncrude oils) which are very sensitive to light, heat and oxygen, for example. Those hydrocarbons are generally shale oils whose principal characteristic is their high nitrogen compound content, particularly basic nitrogen compounds (nitrogen content of at least 1% to 3%), which renders them unacceptable as feeds for conventional treatment processes. Those particular hydrocarbon fractions must, therefore, be pretreated before use, using severe hydrotreatment conditions.

Some industrial countries set standards regarding sulphur content and cetane index, or will shortly limit them. These standards are becoming more strict, particularly for gas oils for use as motor fuels. Thus in France, in particular from 1995, the sulphur content of gas oils will be set at a maximum of 0.05% by weight (500 ppm) while gas oils which conform to current standards can have a sulphur content of up to 0.3%.

Gas oils used in France as internal combustion engine fuels must currently have a cetane index of at least 48 and gas oils used as a domestic fuel must have a cetane index of at least 40. These standards can be expected to become stricter in the near future, in particular those regarding gas oils used as motor fuel.

Further, given the diversity of feeds to be treated (crudes of different origins, from visbreaking, coking, hydroconversion, distillation or catalytic cracking) to produce a gas oil, a flexible process should be available to the refiner which can adapt the products formed to the demand and comply with future specifications regarding sulphur levels, nitrogen levels, cetane index, color and aromatic content.

All the existing processes, such as hydrodearomatisation or hydrocracking, which produce petroleum products with a low sulphur content and a relatively high cetane index, use large quantities of hydrogen. Hydrodearomatisation of a straight run feed with distillation intervals (ASTM D86) of 180° C.<T 5%<300° C., 260° C.<T 50%<350, 350° C.<T 95%<460° C., uses 0.6 to 1.1% of hydrogen with respect to the feed, while hydrocracking requires more than 2% of hydrogen with respect to the feed. Thus the hydrogen feed in a refinery, generally the catalytic reforming unit, is likely to become inadequate as regards the increasing severity of gas oil standards which will necessitate an increase in hydrotreatment.

Further, the current processes produce a petroleum product with a cetane index which does not exceed 63, this latter only being obtainable at the cost of hydrogenating the aromatic hydrocarbons in the feed, a reaction which consumes hydrogen.

The refiner therefore needs a process which can produce a petroleum product which can comply with the various standards which will come into force in the near future, from 1995 in the case of sulphur content. It is also desirable to be able to produce a petroleum product with as little odor as possible.

SUMMARY OF THE INVENTION

The present invention thus concerns a process which is normal to operate and consumes less hydrogen. This process uses industrial hydrotreatment units (mainly hydrofining). It improves the quality of the gas oil produced and can comply with future standards, in particular those regarding sulphur content. The process of the invention can also increase the motor cetane index of the gas oil, reduce the content of aromatic compounds which do not contain a sulphur heteroatom in the molecule, reduce the nitrogen compound content, improve the color and odor and, finally, reduce the formation of solid particles during use in an internal combustion engine. The present invention provides a solution to the specific problem of producing, in as large a quantity as possible with respect to the starting product, a petroleum product which can form part of a blend of a motor quality gas oil or a motor gas oil from a hydrocarbon cut with characteristics which render it difficult to use as a motor gas oil.

The invention also concerns a process for the production of a petroleum product forming a component of a domestic fuel.

More particularly, the invention concerns a process for the production of a base component for a compression ignition internal combustion engine fuel blend, in particular with an improved cetane index and sulphur content, from a hydrocarbon feed with an initial boiling point of at least 150° C. and a final boiling point of at most 500° C., containing about 0.05% to about 5% by weight of sulphur, about 10% to about 60% by weight of n- and isoalkanes, about 10% to about 85% by weight of aromatic hydrocarbons at least partially in the form of polyaromatic compounds (containing sulphur or otherwise), with a cetane index of about 20 to about 60 and a nitrogen content of about 50 to about 5000 ppm (parts per million) by weight, said process being characterised in that it comprises the following steps:

hydrotreatment step a) wherein said feed is hydrotreated under conditions which produce a product (P) containing 2 to 50 times less sulphur, more often 3 to 30 times less than the initial feed, said hydrotreatment generally being carried out at a partial pressure of hydrogen at the reactor outlet of about 0.5 MPa (megapascal) to about 6 MPa, such that the dearomatisation ratio of the feed is at most 30%, separation step b) of product (P), for example by stripping or distillation, into product (P2) with an initial boiling point which is greater than the boiling point of the extraction solvent used in step c) and preferably greater by at least 20° C., and a product (P1) with a final boiling point which is lower than the initial boiling point of product P2, liquid/liquid extraction step c), wherein product (P2) from step b) is brought into contact, at an extraction temperature of at most 140° C., for example 0° C.–80° C., under conditions which will extract polyaromatic compounds, using a solvent or solvent mixture (S1) to extract at least a portion of the polyaromatic compounds contained therein, said solvent or solvent mixture having an initial boiling point which is lower, preferably by at least 20° C., than the initial boiling point of product (P2) from step b), and during which an extract (E1) which is enriched in polyaromatic compounds and a raffinate (R1) are recovered, and solvent recovery step d), for example by distillation or stripping, for recovering solvent (S1) used in step c) from raffinate (R1) produced in step c), wherein a product which is enriched in solvent (S1) and a product (Q1) which is depleted in solvent (S1), which has improved qualities and which contains less than 500 ppm of sulphur, are recovered.

For simplicity, the term hydrofining (HDS) will be used instead of hydrotreatment throughout the remainder of the description.

The term "polyaromatics" means compounds with at least two aromatic rings which may or may not contain sulphur.

The initial and final boiling points are TBP cut points.

The hydrocarbon feed treated using the process of the invention is most often termed a gas oil cut and preferably has an initial boiling point of about 150° C. and a final boiling point of about 400° C. The sulphur content is normally greater than 0.1% and most often more than 0.5% by weight, the n- and isoalkane content being about 15% to about 65% by weight. This feed is most often a straight cut gas oil, a pyrolysis gas oil or a mixture of the two. This feed can advantageously be mixed with a LCO (light cycle oil) cut from a catalytic cracking unit, preferably in a LCO/gas oil ratio of 1:4 to 1:1, the color of the feed, measured using the standard ASTM D 1500, is normally greater than or equal to 2. The cetane index of the feed, measured according to standard ISO 5165, is most often below about 60, for example about 50 to about 55. The nitrogen content of the feed is very often about 100 to about 1000 ppm, expressed as the weight of nitrogen with respect to the weight of the feed.

Product Q1 obtained is a novel product as regards the totality of its characteristics (cut point, cetane, paraffin content and sulphur content) which are of particular interest in blending high quality fuels with other gas oil cuts.

Product (Q1) obtained by the process of the present invention normally has a nitrogen content, expressed as the weight of nitrogen, which is 2 times less than that of the initial feed and often 4 to 5 times less. The color of this product (Q1), measured using ASTM 1500 is normally less than 1 and the cetane index of this product is generally greater by at least 3 points and often at least 5 points greater than that of the initial feed (for example 3 to 14 points). The sulphur content, with respect to that of the feed, is generally less than or equal to 5% by weight. The n- and isoalkane content generally increases by at least 4 points, advantageously by 5 to 20 points and most often by 6 to 11 points with respect to that of the feed. The concentration of aromatic compounds which do not contain a sulphur atom in the molecule in product (Q1) is normally reduced to at least 10% by weight with respect to that of the initial feed and often by at least 30% by weight. The odor of the product is less strong than that of the initial feed.

The invention advantageously concerns a petroleum product characterised in that the distillation cut corresponds to 95% by weight distilling between 320° C. and 460° C., a cetane index of greater than 60, an n- and isoalkane content of at least 48% by weight, and a sulphur content less than or equal to 500 ppm (by weight).

In accordance with the present invention, hydrofining is advantageously carried out in a hydrofining unit under mild conditions which remove the sulphur from the sulphur-containing molecules by hydrogenating as little as possible. This method of operation is not obvious to the skilled person of the 1990s, who rather would be led to the solution of making the hydrotreatment conditions more severe to simultaneously reduce the sulphur content and increase the cetane index of the feed. Under these conditions, the temperature is 320° C. to 370° C., the hourly space velocity is 1 to 5, the pressure is 1 to 5 MPa and the volume ratio of $H_2$ to feed is 50 to 350 $Nm^3/m^3$. The dearomatisation ratio of the feed is thus at most about 15%. Two particularly advantageous cases can thus be distinguished for this hydrofining reaction which can produce an excellent feed for the subsequent extraction step.

In the first preferred case, a catalyst is used which is selective for hydrofining sulphur-containing molecules as opposed to hydrogenation of aromatics, in order to limit hydrogenation A catalyst sold by PROCATALYSE may be used, for example, at a partial pressure of hydrogen at the hydrofining reactor outlet which is advantageously between about 110 MPa and about 3.0 MPa. Product (P) is recovered which contains 2 to 30 times less sulphur, i.e., between 0.1% and 0.3% by weight depending on the feed, for example, and most often 3 to 10 times less than that of the initial feed. The dearomatisation ratio of the feed is thus substantially less than 10%. The other operating conditions for this hydrofining step are such that normal, mild conventional hydrofining conditions are used which are known to the skilled person.

In the second case, a conventional catalyst is used which can limit hydrogenation, for example a catalyst sold by PROCATALYSE, at a partial pressure of hydrogen at the hydrofining reactor outlet which is advantageously between about 2 MPa and about 5 MPa. A product (P) is recovered which contains 5 to 60 times less sulphur, i.e., less than 0.1% by weight, for example between 0.02% and 0.05%, and most often 10 to 40 times less than that of the initial feed. The dearomatisation ratio of the feed is thus at most 15%. The other operating conditions for this hydrofining step are those for conventional, more severe hydrofining. This hydrofining step is carried out using a larger volume of catalyst than in the case of normal hydrofining, for example a volume of catalyst which is twice as large, and a higher pressure of hydrogen, calculated to carry out more thorough hydrogenation.

Descriptions of several commercially available hydrofining catalysts and the industrial conditions for hydrofining can be found, for example, in volume 1 of "PETROLE, RAFFINAGE ET GÉNIE CHIMIQUE" by P WUITHIER, edited by TECHNIP, pp 816–831. A catalyst which contains molybdenum and cobalt, known to limit hydrogenation, may, for example, be selected.

The separation step, which is known in the art, normally comprises vapor stripping the whole of the hydrotreatment liquid effluent, which may or may not be followed by a complementary distillation step. This latter step is generally required when a fraction P2 which has an initial boiling point which is higher than that of the stripped hydrotreatment effluent is to be sent to the extraction step. The operating conditions are generally: reduced pressure of less than 1 bar, advantageously 10 to 100 mbar, preferably 20 to 50 mbar (1 bar=$10^5$ Pa), and a temperature of between 80° C. and 250° C.

The liquid/liquid extraction step is carried out under conventional conditions Counter-current extraction can, for example, be carried out in a conventional apparatus, for example a packed column, a tray column or a mechanically agitated column (RDC: rotating disc contactor), generally with an efficiency of 3 to 20 theoretical plates, preferably 5 to 10 theoretical plates, at a temperature generally of between 0° C. and 140° C., advantageously between 30° C. and 80° C., at a pressure which allows liquid phase operation, i.e., between 0:1 and 1 MPa, preferably between 0.1 and 0.6 MPa. The ratio of the volume of solvent (S1) to volume of product (P2) obtained in step b) is preferably about 0.2:1 to about 5:1, advantageously 0.5:1 to 2:1, and most often about 1:1. The solvent is preferably selected from the group of solvents which also extract at least a portion of the aromatic compounds which do not contain a sulphur atom in the molecule which are present in product (P2) obtained from step b). The extraction conditions are preferably selected so as to obtain a raffinate (R1) containing at most 90% by weight, preferably at most 70% of the total weight of aromatic compounds which do not contain a sulphur atom in the molecule, present in product (P2) obtained from step b). Under these conditions, extract (E1) contains at least 10%, often at least 30% by weight of the total weight of aromatic compounds which do not contain a sulphur atom in the molecule present in product (P2) obtained from step b), also preferably at least 30%, often at least 50% and frequently at least 80% by weight of the total weight of sulphur-containing compounds, most often dibenzothiophenes and naphthobenzothiophenes which are initially contained in product (P2). Product (Q1) thus obtained normally contains 2 to 10 times less sulphur than product (P2) from step b), most often 4 to 10 times less.

The extraction solvent is most often a single solvent, although a mixture of solvents can be used. The solvent generally contains less than 20%, often less than 10% by weight of water. The solvent can be anhydrous. It is usually selected from the group formed by methanol, acetonitrile, monomethylformamide, dimethylformamide, dimethylacetamide, furfural, N-methylpyrrolidone and dimethylsulphoxide. Very often, a solvent is used which does not contain nitrogen, preferably an oxygenated solvent which does not contain nitrogen. The preferred solvent is furfural.

At least one cosolvent can be added to the extraction solvent. This may be an alcohol containing 1 to 6 carbon atoms, for example a linear or branched alcohol, or furfuryl alcohol.

If the feed to be treated has a high final boiling point and is particularly rich in nitrogen compounds, especially basic nitrogen compounds, it may be of advantage to introduce a small amount of acids, in particular carboxylic acids (less than 1% by weight with respect to the solvent, for example) with the extraction solvent, either alone or as a mixture. Examples are carboxylic acids containing 1 to 6 carbon atoms, more particularly acids with a boiling point which is below 250° C., in particular formic acid, acetic acid, propionic acid, butanoic acid, pentanoic acid, maleic acid, crotonic acid, isobutyric acid, valeric acid, trimethylacetic acid, benzoic acid and 2-furoic acid.

The solvent can be recovered from the raffinate by stripping or by distillation, preferably by vapor stripping under the conditions described above.

Raffinate (R1) obtained from step c) is sent to step d), for example to a vapor stripping zone where it is separated under conditions which allow recovery of an overhead fraction which is enriched, preferably highly enriched, in solvent (S1) and a bottom product (Q1) which is preferably very depleted in solvent (S1). In general, the separation conditions are selected so as to obtain an overhead fraction which contains substantially all of the solvent, for example more than 95% by weight of the quantity of solvent contained in raffinate (R1) and introduced into the stripping zone. Preferably, at least about 99% by weight of the quantity of solvent contained in raffinate (R1) is recovered.

In a particular embodiment, extract (E1) obtained from step c) is then sent to a recovery zone for solvent (S1) used in step c) from which a solvent (S1) enriched product and a solvent (S1) depleted product (Q2) is recovered. Separation of the solvent from the extract is generally effected by distillation and/or vapour stripping, preferably by distillation followed by vapour stripping under the conditions described above. This extract is thus separated under conditions whereby a fraction which is enriched, preferably highly enriched, in solvent (S1) is recovered overhead, along with a bottom product (Q2) which is depleted in solvent (S1). In general, the conditions for this separation step are selected so as to obtain an overhead fraction containing substantially all the solvent, i.e., for example more than 95% by weight of the quantity of solvent contained in extract (E1) and introduced into this separation zone. Preferably, at least about 99% by weight of the quantity of solvent contained in extract (E1) is recovered.

In step a), when operating under substantially more severe hydrofining conditions, i.e., in particular in the presence of a very large quantity of catalyst, product (Q2) obtained by distillation of extract (E1) will have a sulphur content which is generally less than or equal to about 0.3% by weight. This product (Q2) is, of course, not suitable as a motor fuel since it often has a sulphur content which is higher than the future standard; on the other hand, it could quite probably be used as a domestic fuel.

In a particularly advantageous embodiment of the invention, the solvent enriched overhead product(s) obtained by separation of raffinate (R1) and optionally extract (E1), are recycled to liquid/liquid extraction step c).

In a particular embodiment of the process of the invention, at least a portion of product (Q2) obtained from extract (E1) after separation of solvent (S1) is sent to a separate hydrofining zone from the hydrofining zone for the initial feed, or it is returned to the hydrofining zone of step a). In this zone, which is separate from the hydrofining zone of step a), the portion of product (Q2) is hydrofined under conditions which produce a product (P3) with a sulphur content which is less than or equal to 0.3% by weight, preferably less than or equal to 0.2% by weight.

In a variation of the process of the invention, the hydrocarbon feed with an initial boiling point of at least 150° C. and a final boiling point of at most 500° C. is sent to a distillation zone where an overhead fraction (F1) is separated which has a final boiling point of at least 250° C., along with a bottom fraction (F2) which has an initial boiling point of at least 250° C. In this variation, fraction (F2) is treated using steps a) to d) of the process described above for the 150°–500° C. hydrocarbon feed. Fraction (F1) is sent to a hydrofining zone which is separate from that of step a) where it is hydrofined under conventional conditions, for example the normal conditions described above. Hydrofined product (P') obtained is sent to a separation zone, for example a stripping or distillation zone, to separate it into a fraction (P10) with a final boiling point of less than 150° C., and a fraction (P20) with an initial boiling point which is higher than the final boiling point of fraction (P10). At least a portion of product (P20) can be mixed with product (Q1) obtained from fraction (F2) to form a product (Q10) with the required qualities of a motor fuel. Fraction (P10) is principally constituted by compounds resulting from secondary reactions during hydrofining. Fraction (P10) generally represents less than 2% by volume of the total volume of fraction (F1).

The principal advantages of the invention are as follows: a higher concentration of n-and isoalkanes is obtained in the raffinate than from hydrocracking or hydrodearomatisation processes, along with a higher cetane index, despite an aromatic hydrocarbon content of more than 10%. In addition, the hydrotreatment consumes less hydrogen. It can, for example, be reduced to 0.15% by weight with respect to the feed, when hydrogenation is limited to the maximum.

COMPARATIVE TABLE

| | hydro-cracking | hydrodearoma-tisation | HDS and extraction |
|---|---|---|---|
| density | 0.815–0.825 | 0.820–0.850 | 0.815–0.840 |
| cetane | 53–63 | 45–60 | 62–71 |
| n- and isoalkanes* | 42–47 | 35–45 | 49–56 |
| Naphthenes* | 49–55 | 25–55 | 30–41 |
| Aromatics* | 3–7 | 10–20 | 10–20 |
| % Hydrogen** consumption | >2 | 0.6–1.1 | <0.5 |

A comparison of the chromatogram profiles of the sulphur-containing compounds (gas phase chromatograph detector: Sievers) shows that, for the combination of HDS and extraction (raffinate), the sulphur-containing compounds recovered in the raffinate are mainly benzothiophenes. The dibenzothiophenes and naphthobenzpthiophenes are found mainly in the extract. For conventional schemes, however, whether for severe hydrofining or for hydrodearomatisation, the sulphur-containing compounds remaining in the petroleum product are principally dibenzothiophenes and naphthobenzothiophenes.

DETAILED DESCRIPTION OF THE DRAWINGS

Figure 1:
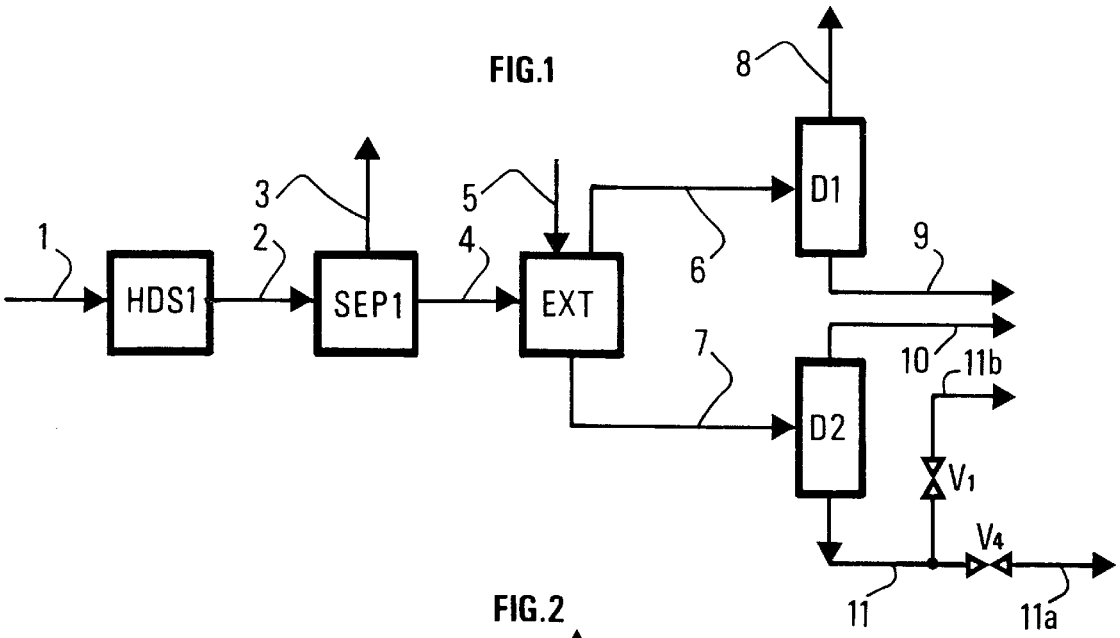
FIGS. 1 and 2 are schematic representations of the main variations of the process of the invention. In the figures, similar devices are designated by the same reference letters and numbers.

In FIG. 1, the hydrocarbon feed to be treated is sent via line (1) to hydrofining zone (HDS1). Product (P) is recovered at the outlet via line 2 and sent to separation zone (SEP 1) from which product (P1) is recovered via line 3 and product (P2) is recovered via line 4 with an initial boiling point which is higher than the final boiling point of product (P1). Product (P2) is sent via line 4 to extraction zone (EXT) into which extraction solvent (S1) is introduced via line 5 and from which extract (E1) is recovered via line 7. Raffinate (R1) is recovered via line 6 and sent to recovery zone (D1) to recover solvent (S1) via line 8. A petroleum product (Q1) which may be used as a base for a motor gas oil blend with improved qualities, is recovered via line 9. Extract (E1) is sent via line 7 to recovery zone (D2) to recover solvent (S1) via line 10 and product (Q2) via line 11. At least a portion of product (Q2) can be recovered via line 11*a* when valve V4 is open, or when valve V1 is open, at least a portion can be sent via line 11*b* either to hydrofining zone (HDS3) which is not shown, or to hydrofining zone (HDS1). When product (Q2) is recovered via line 11*a* it can be used as a domestic fuel but it will not comply with future standards for motor gas oils and thus it cannot be used as it is as a fuel.

Figure 2:
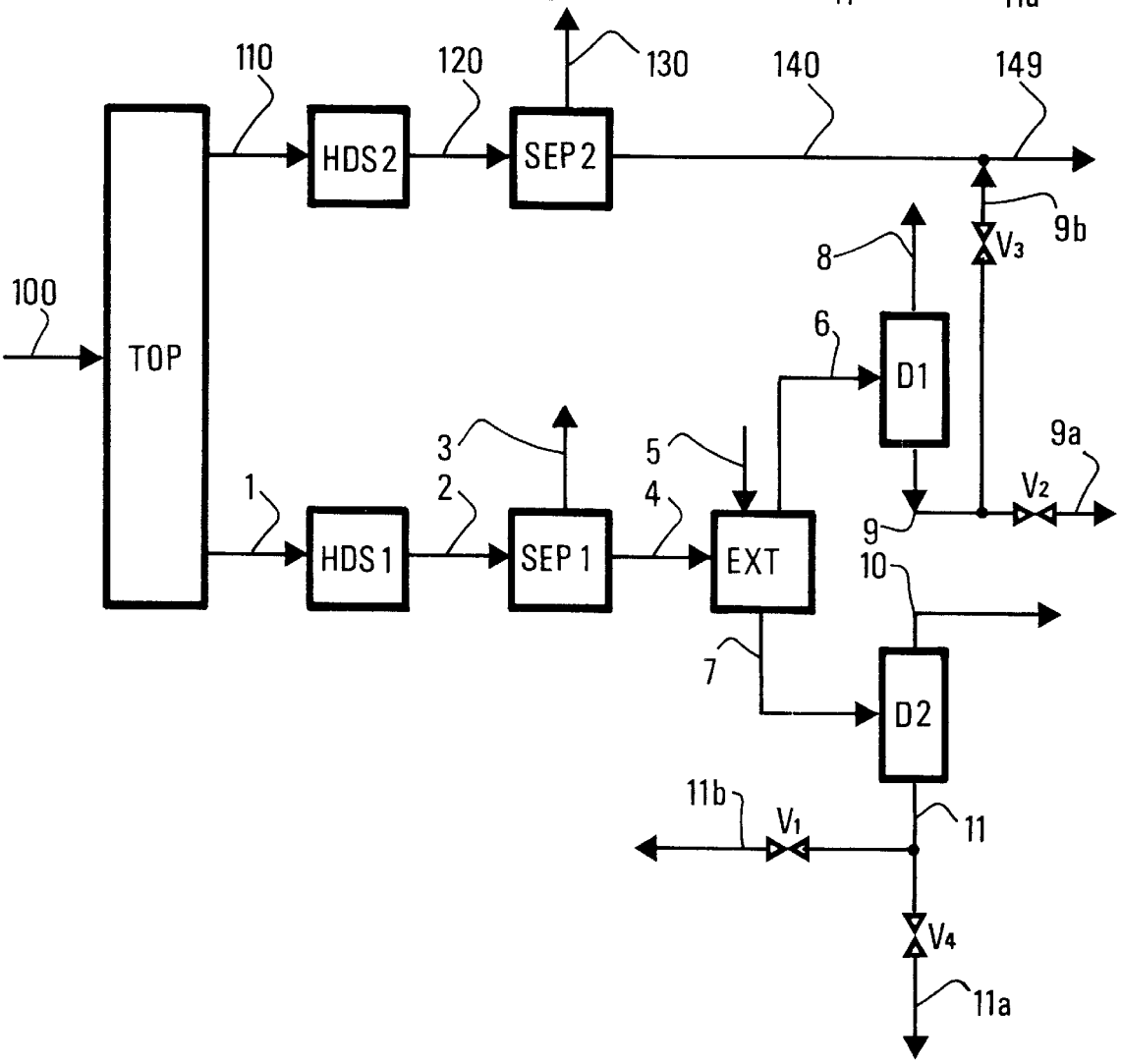

In FIG. 2, the hydrocarbon feed to be treated is sent via line (100) to zone (TOP) from which heavy fraction (F2), with an initial boiling point of more than 250° C., is recovered and treated as the hydrocarbon feed in the above description with reference to FIG. 1. From zone (D1), product (Q1) can be at least partially recovered via line 9 and line 9*a* when valve V2 is open, or sent at least in part via line 9*b* to line 140 when valve V3 is open. When it is recovered via line 9*a,* this petroleum product forms part of the base for an improved quality motor gas oil blend A light fraction (F1) is recovered from zone (TOP) via line 110 with a final boiling point of more than about 250° C. This fraction (F1) is sent via line 110 to a hydrofining zone (HDS2), at the outlet of which a hydrofined product (P') is recovered via line 120 which is sent to separation zone (SEP2) from which product (P10) is recovered via line 130 and product (P20) is recovered via line 140 with an initial boiling point which is higher than the final boiling point of product (P10). Product (P20) is optionally mixed with product (Q1) arriving via line 9*b.* This mixture or product (P20) forms a base for a motor gas oil blend with improved qualities which is recovered via line 149.

The following examples illustrate the invention without limiting its scope.

EXAMPLES

Example 1

The feed used in this example was a straight run gas oil cut with a cetane index of 55, a total aromatic compound content (sulphur-containing and non sulphur-containing) of 30% by weight, an n- and isoalkane content of 39% by weight, a naphthene concentration of 31%, a sulphur content of 1.22% by weight, a nitrogen content, expressed as weight of nitrogen, of 255 ppm and a colour, measured using ASTM D 1500, of 2. This gas oil cut had an initial distillation point of 150° C. and a final distillation point of 400° C.

The feed was introduced via line 1 into a hydrofining zone and subjected to hydrofining at a partial hydrogen pressure of 2.0 MPa in the presence of an industrial catalyst containing cobalt and molybdenum on an alumina support, sold by PROCATALYSE under reference number HR 306C. The temperature was maintained at 330° C., the quantity of hydrogen introduced was 200 liters per liter of feed and the hourly space velocity was 2.5 $h^{-1}$. The quantity of hydrogen consumed was 0.25% by weight with respect to the feed.

A product (P) was recovered via line 2 which contained 0.2% by weight of sulphur, 28% by weight of sulphur-containing and non sulphur-containing aromatic compounds and an n- and isoalkane content of 40%. The colour of this product, measured according to ASTM D-1500, was less than 1 and the nitrogen content was 175 ppm by weight. The cetane index of product (P) was 56. The product had a final distillation point of 400° C. It was sent to a steam stripping zone (SEP1) from which a product (P1) was recovered via line 3, with a final distillation point of 220° C., and a product (P2) was recovered with an initial distillation point of 220° C. and a final distillation point of 400° C. This product (P2), after cooling to 70° C., i.e., to the temperature of the extraction zone, was sent to the extraction zone (EXT) via line 4, into which a volume of furfural equal to the volume of product (P2) introduced into said zone, was introduced via line 5. This zone was an extraction column packed with Pall rings with an overall efficiency substantially equal to three theoretical plates. Counter-current extraction was carried out at atmospheric pressure and at a temperature of 70°

C. A raffinate (R1) was obtained which was sent via line 6 to vapour stripping zone (D1) from which furfural was separated overhead and recovered via line 8 for optional recycling to the extraction zone, and raffinate (Q1) was recovered as a bottom product which contained less than 5 ppm of furfural, for example, and had a sulphur content of 0.04% by weight, a cetane index of 67, a sulphur-containing and non sulphur-containing aromatic compound content of 12% by weight, an n- and isoalkane content of 49%, a nitrogen content of 40 ppm and a Saybolt color of 30 which could be introduced into the gas oil pool. From this extraction zone, an extract (E1) was recovered which was sent to distillation zone (D2) followed by a vapor stripping zone in which furfural was separated overhead and recovered via line 10 for optional recycling to the extraction zone, and extract (Q2) was recovered from the bottom which contained practically no furfural, had a sulphur content of 0.6% by weight, a cetane index of 25, a sulphur-containing and non sulphur-containing aromatic compound content of 77% and a nitrogen content of 500 ppm.

Product (Q2) could be sent via lines 11 and 11*b* to hydrofining zone (HDS3) which was separate from that into which the initial feed was introduced. This hydrofining was carried out in the presence of catalyst HR 306C, at a partial pressure of hydrogen of 2.5 MPa, at a temperature of 330° C. with a hydrogen recycle of 200 liters per liter of feed and a space velocity of 2.5 $h^{-1}$. A product with a sulphur constituent of 0.2% by weight was obtained from the outlet to this hydrofining zone. The other characteristics were practically unchanged. The product could be used as a domestic fuel, i.e., introduced into the domestic fuel pool.

Example 2

The feed used in this Example was the same as that used in Example 1.

The feed was introduced via line 1 into a hydrofining zone and subjected to hydrofining at a partial pressure of hydrogen of 2.5 MPa in the presence of an industrial catalyst containing cobalt and molybdenum on an alumina support, sold by PROCATALYSE under reference number HR 306C. The temperature was maintained at 330° C., the quantity of hydrogen was 200 liters per liter of feed and the hourly space velocity was 1 $h^{-1}$. The quantity of hydrogen consumed was 0.4% by weight with respect to the feed.

A product (P) was recovered via line 2 which contained 0.05% by weight of sulphur, 27% by weight of sulphur-containing and non sulphur-containing aromatic compounds and an n- and isoalkane content of 40% by weight. The color of this product, measured according to ASTM D-1500, was less than 1 and the nitrogen content was 130 ppm by weight. The cetane index of product (P) was 57. The product had a final distillation point of 400° C. It was sent to a steam stripping zone (SEP1) from which a product (P1), with a final distillation point of 220° C., was recovered via line 3, and a product (P2) was recovered via line 4 which had an initial distillation point of 220° C. and a final distillation point of 400° C. This product (P2), after cooling to 70° C., was sent to the extraction zone (EXT) via line 4, into which a volume of furfural equal to the volume of product (P2) introduced into said zone, was introduced via line 5. This zone was an extraction column packed with Pall rings with an overall efficiency substantially equal to three theoretical plates. Counter-current extraction was carried out at atmospheric pressure and at a temperature of 70° C. A raffinate (R1) was obtained which was sent via line 6 to vapor stripping zone (D1) from which furfural was separated overhead and recovered via line 8 for optional recycling to the extraction zone and raffinate (Q1) was recovered as a bottom product which contained practically no furfural, had a sulphur content of 0.1% by weight, a cetane index of 69, a sulphur-containing and non sulphur-containing aromatic compound content of 10% by weight, an n- and isoalkane content of 50% by weight, a nitrogen content of 20 ppm and a Saybolt colour of 30. This raffinate was sent to the gas oil pool via line 9. From this extraction zone, an extract (E1) was recovered which was sent to a distillation zone followed by a vapor stripping zone (D2) in which furfural was separated overhead and recovered via line 10 for optional recycling to the extraction zone and extract (Q2) was recovered from the bottom which contained practically no furfural, had a sulphur content of 0.15% by weight, a cetane index of 26, a sulphur-containing and non sulphur-containing aromatic compound content of 77% and a nitrogen content of 500 ppm.

Product (Q2) could be sent via lines 11 and 11*b* to the domestic fuel pool.

Example 3

The feed used in this Example was the same as that used in Example 1.

The feed was introduced via line 1 into a hydrofining zone and subjected to hydrofining at a partial pressure of hydrogen of 2.5 MPa in the presence of an industrial catalyst containing cobalt and molybdenum on an alumina support, sold by PROCATALYSE under reference number HR 306C. The temperature was maintained at 330° C., the quantity of hydrogen introduced was 200 liters per liter of feed and the hourly space velocity was 1 $h^{-1}$. The quantity of hydrogen consumed was 0.4% by weight with respect to the feed.

A product (P) was recovered via line 2 which contained 0.05% by weight of sulphur and 27% by weight of sulphur-containing and non sulphur-containing aromatic compounds. The color of this product, measured according to ASTM D-1500, was less than 1 and the nitrogen content was 130 ppm by weight. The cetane index of product (P) was 57. The product had a final distillation point of 400° C. Product (P) was stripped with water vapour to eliminate the light fractions (<150° C.) and hydrogen sulphide formed in the hydrofining reactor (less than 2% of the initial feed). Product (P) was sent to a distillation zone from which a product (P1) was recovered via line 3, with a final distillation point of 300° C., and a product (P2) was recovered via line 4 with an initial distillation point of 300° C. Product (P2), after cooling to 70° C., was sent to the extraction zone (EXT) via line 4, into which a volume of furfural equal to the volume of product (P2) introduced into said zone was introduced via line 5. This zone was an extraction column packed with Pall rings with an overall efficiency substantially equal to three theoretical plates. Counter-current extraction was carried out at atmospheric pressure and at a temperature of 70° C. A raffinate (R1) was obtained which was sent via line 6 to distillation zone (D1) from which furfural was separated overhead, and recovered via line 8 for optional recycling to the extraction zone, and raffinate (Q1) was recovered via line 9 as a bottom product which contained practically no furfural. At least a portion of product (Q1) was mixed with at least a portion of product (P1) whose light fraction had been removed to produce a fraction (F) with a sulphur content of 0.01% by weight, a cetane index of 62, a sulphur-containing and non sulphur-containing aromatic compound content of 15% by weight, an n- and isoalkane content of 49% by weight, a nitrogen content of 30 ppm and a Saybolt colour of 20. This fraction 7 was mixed with the gas oil pool. From this extraction zone, an extract (E1) was recovered which was sent to distillation zone (D2) in which furfural was separated overhead and recovered via line 10 for optional recycling to the extraction zone, and extract (Q2) was recovered from the bottom which contained practically no furfural, had a sulphur content of 0.25% by weight, a cetane index of 25, a sulphur-containing and non sulphur-containing aromatic compound content of 82% and a nitrogen content of 700 ppm.

Product (Q2) could then be treated as described above for Example 1.

Example 4

The feed used in this Example was the same as that used in Example 1. It was introduced via line 100 into the distillation zone from which a fraction (F1) was recovered via line 110 with an initial boiling point of 150° C. and a final boiling point of 300° C. This fraction was introduced via line 110 into a hydrofining zone and subjected to hydrofining at a partial pressure of hydrogen of 2.0 MPa in the presence of an industrial catalyst containing cobalt and molybdenum on an alumina support, sold by PROCATALYSE under reference number HR 306C. The temperature was maintained at 330° C., the quantity of hydrogen introduced was 150 liters per liter of feed and the hourly space velocity was 4 $h^{-1}$. The quantity of hydrogen consumed was 0.05% by weight with respect to the feed. A product (P') was recovered via line 120 which contained 0.005% by weight of sulphur and 20% by weight of sulphur-containing and non sulphur-containing aromatic compounds. The color of this product, measured according to ASTM D-1500, was less than 1 and the nitrogen content was 20 ppm by weight The cetane index of product (P') was 57. The product had a final distillation point of 300° C. Product (P') was sent to a water vapor stripping zone (SEP2) from which a product (P10) was recovered via line 130, with a final distillation point of 150° C., and a product (P20) was recovered via line 140 which had an initial distillation point of 150° C. and a final distillation point of 300° C. This product (P20) was sent via line 140 and line 149 to the motor fuel pool A fraction (F2) was recovered via line 1 from distillation zone (TOP) with an initial boiling point of 300° C. and a final boiling point of 400° C. The aromatic hydrocarbon content was 37% by weight and the n- and isoalkane content was 34% by weight This feed was introduced via line 1 into a hydrofining zone and subjected to hydrofining at a partial pressure of hydrogen of 3.0 MPa in the presence of an industrial catalyst containing cobalt and molybdenum on an alumina support, sold by PROCATALYSE under reference number HR 316C. The temperature was maintained at 350° C., the quantity of hydrogen introduced was 200 liters per liter of feed and the hourly space velocity was 1 $h^{-1}$. The quantity of hydrogen consumed was 0.45% by weight with respect to the feed.

A product (P) was recovered via line 2 which contained 0.15% by weight of sulphur, 34% by weight of sulphur-containing and non sulphur-containing aromatic compounds and an n- and isoalkane content of 35%. The colour of this product, measured according to ASTM D-1500, was less than 2 and the nitrogen content was 300 ppm by weight. The cetane index of product (P) was 56. The product had a final distillation point of 400° C. It was sent to a steam stripping zone (SEP1) from which a product (P1) was recovered via line 3, with a final distillation point of 300° C. and a product (P2) was recovered via line 4 which had an initial distillation point of 300° C. and a final distillation point of 400° C. This product (P2), after cooling to 70° C., was sent to the extraction zone (EXT) via line 4, into which a volume of furfural equal to the volume of product (P2) introduced into said zone, was introduced via line 5. This zone was an extraction column packed with Pall rings with an overall efficiency substantially equal to three theoretical plates. Counter-current extraction was carried out at atmospheric pressure and at a temperature of 70° C. A raffinate (R1) was obtained which was sent via line 6 to vapor stripping zone (D1) from which furfural was separated overhead and recovered via line 8 for optional recycling to the extraction zone and raffinate (Q1) was recovered as a bottom product which contained practically no furfural, had a sulphur content of 0.04% by weight, a cetane index of 67, a sulphur-containing and non sulphur-containing aromatic compound content of 20%, an n- and isoalkane content of 48% by weight, a nitrogen content of 30 ppm and a Saybolt color of 20. From this extraction zone, an extract (E1) was recovered which was sent to distillation zone (D2) in which furfural was separated overhead and recovered via line 10 for optional recycling to the extraction zone and extract (Q2) was recovered from the bottom which contained practically no furfural, had a sulphur content of 0.5% by weight, a cetane index of 25, a sulphur-containing and non sulphur-containing aromatic compound content of 80% and a nitrogen content of 1000 ppm.

Product (Q1) was sent via lines 9, 9*b* and 149 to a motor fuel pool. The mixture of P20 and Q1 was a product with a cetane index of 61, a sulphur-containing and non sulphur-containing aromatic compound content of 23%, a sulphur content of 0.02% by weight, a nitrogen content of 300 ppm and a Saybolt color of 25.

This mixture could also be mixed, at least in part, with at least a portion of stripped product P1.

Example 5

A straight run gas oil feed with a distillation point of 150° C. and a final distillation point of 400° C., containing 35% by weight of aromatics and sulphur-containing compounds and 10% of di- and polyaromatics, was treated in accordance with Example 1 under the following hydrotreatment conditions:

| Partial pressure of hydrogen (MPa) | Product P Aromatics + sulphur containing compounds wt % | Product P Di- & poly-aromatics wt % | Cetane gain between Q1&P after extraction (at isoyield) |
|---|---|---|---|
| 3.0 | 34 | 7 | +12 |
| 5.0 | 32 | 4 | +10 |
| 7.0 (comparative) | 23 | 1 | +6 |

Knowing that a cetane gain of 14 points has been observed for direct liquid-liquid extraction, this Example shows that the performance of the downstream extraction unit depends on the severity of the hydrotreatment step.

In particular, the gain was larger when the aromatic hydrocarbon content of the hydrotreatment effluent was substantially identical to that of the initial feed, and the hydrogenation step of the di- and polyaromatic hydrocarbons was limited.

It can thus be seen that selection of the conditions for the hydrotreatment step of the process of the invention determines the performance of the extraction step.

Example 6

The feed used in this Example was a mixture of a straight run gas oil cut and a LCO gas oil cut from a catalytic cracking unit.

The straight run gas oil cut had a density of 857 at 15° C., a refraction index of 1.4617 at 60° C., a cetane index of 55, a total sulphur-containing and non sulphur-containing aromatic compound content of 35.4% by weight, an n- and isoalkane and a naphthene content of 64,6% by weight, a sulphur content of 1.33% by weight and a nitrogen content, expressed as weight of nitrogen, of 124 ppm.

The LCO gas oil cut had a density of 944.1 at 15° C., a refraction index of 1.5245 at 60° C., a cetane index of 23, a total sulphur-containing and non sulphur-containing aromatic compound content of 67.4% by weight, an n- and isoalkane and naphthene content of 32.6% by weight, a sulphur content of 3.13% by weight and a nitrogen content, expressed as weight of nitrogen, of 930 ppm.

Feed $C_1$ contained 80% of the straight run gas oil and 20% of the LCO cut. Feed $C_2$ contained 50% of the straight run gas oil and 50% of the LCO cut. Cuts $C_1$ and $C_2$ had an initial distillation point of 200° C. and a final distillation point of 400° C. This feed was introduced via line 1 into a hydrofining zone and subjected to hydrofining at a partial pressure of hydrogen of 2.0 MPa in the presence of an industrial catalyst containing cobalt and molybdenum on an alumina support, sold by PROCATALYSE under reference number HR 306C. The temperature was maintained at 330° C., the quantity of hydrogen introduced was 200 liters per liter of feed and the hourly space velocity was 2.5 $h^{-1}$. The quantity of hydrogen consumed was 0.25% by weight with respect to the feed.

A product (P') was recovered via line 2 which had a density of 862.2 at 15° C. and contained 0.051% by weight of sulphur, 31% by weight of sulphur-containing and non sulphur-containing aromatic compounds, an n- and isoalkane content of 61% and 285 ppm of nitrogen.

The cetane index of product (P') was 53. The product had a final distillation point of 400° C. It was sent to a steam stripping zone (SEP1) from which a product (P'1) was recovered via line 3, with a final distillation point of 230° C., and a product (P'2) was recovered via line 4 which had an initial distillation point of 230° C. and a final distillation point of 400° C. This product (P'2), after cooling to 70° C., i.e., the temperature of the extraction zone, was sent to extraction zone (EXT) via line 4, into which a volume of furfural equal to the volume of product (P'2) introduced into said zone, was introduced via line 5. This zone was an extraction column packed with Pall rings with an overall efficiency substantially equal to three theoretical plates. Counter-current extraction was carried out at atmospheric pressure and at a temperature of 70° C. A raffinate (R'1) was obtained which was sent via line 6 to vapour stripping zone (D1) from which furfural was separated overhead and recovered via line 8 for optional recycling to the extraction zone and raffinate (Q'1) was recovered as a bottom product which contained less than 5 ppm of furfural, for example, had a sulphur content of 0.02% by weight, a cetane index of 67.3, a sulphur-containing and non sulphur- containing aromatic compound content of 19.1%, an n- and isoalkane and naphthene content of 80.9% by weight, a nitrogen content of 54 ppm and a density of 826.5 at 15° C. This raffinate was sent to the gas oil pool. From this extraction zone, an extract (E'1) was recovered which was sent to distillation zone (D2) followed by a vapour stripping zone in which furfural was separated overhead and recovered via line 10 for optional recycling to the extraction zone and extract (Q'2) was recovered from the bottom which contained practically no furfural, had a sulphur content of 0.14% by weight, a sulphur-containing and non sulphur-containing aromatic compound content of 87.2%, a nitrogen content of 800 ppm, an n- and isoalkane and naphthene content of 12.8% by weight and a density of 1002.8 at 15° C.

Feed $C_2$ underwent the same treatment as feed $C_1$.

A product (P") was recovered via line 2 which had a density of 888.1 at 15° C. and contained 0.067% by weight of sulphur, 44.6% by weight of sulphur-containing and non sulphur- containing aromatic compounds an n- and isoalkane and naphthene content of 47.4% and 527 ppm of nitrogen.

The cetane index of product (P") was 43. The product had a final distillation point of 400° C.

Product (P"1) was recovered via line 3, with a final distillation point of 230° C. and product (P"2) was recovered via line 4 which had an initial distillation point of 230° C. and a final distillation point of 400° C.

Raffinate (R"1) was obtained after extraction and was sent via line 6 to vapour stripping zone (D1) in the same way as raffinate (R'1). Raffinate (Q"1), recovered as a bottom product, contained less than 5 ppm of furfural, for example, had a sulphur content of 0.02% by weight, a cetane index of 66.1, a sulphur-containing and non sulphur-containing aromatic compounds, content of 17% an n- and isoalkane and naphthene content of 83% by weight, a nitrogen content of 150 ppm and a density of 883.9 at 15° C.

Extract (E"1) was extracted and sent to distillation zone (D2) followed by a vapour stripping zone. Bottom extract (Q"2) contained practically no furfural, had a sulphur content of 0.12% by weight, a sulphur-containing and non sulphur-containing aromatic compound content of 87.9%, a nitrogen content of 900 ppm, 12.1% by weight of n- and isoalkanes and naphthenes, and a density of 985.3 at 15° C. Products Q'2 and Q"2 could be sent via lines 11 and 11*b* to hydrofining zone (HDS3) which was separate from that into which the initial feed had been introduced. This hydrofining step was carried out in the presence of catalyst HR 306C, at a partial pressure of hydrogen of 2.5 MPa, at a temperature of 330° C., a hydrogen recycle of 200 liters per liter of feed and an hourly space velocity of 2.5 $h^{-1}$. A product was obtained from the outlet of the hydrofining step which had a sulphur content of 0.2% by weight. The remaining characteristics were practically unchanged. This product could be mixed with domestic fuel, i.e., introduced into the domestic fuel pool.

We claim:

1. A process for the production of a base component for a compression ignition internal combustion engine fuel blend with an improved cetane index and sulphur content, from an initial hydrocarbon feed with an initial boiling point of at least 150° C. and a final boiling point of at most 500° C., containing about 0.05% to about 5% by weight of sulphur, about 10% to about 60% by weight of n- and isoalkanes, about 10% to about 85% by weight of aromatic hydrocarbons at least partially in the form of polyaromatic compounds optionally containing sulphur, with a cetane index of about 20 to about 60 and a nitrogen content of about 50 to about 5000 ppm by weight, said process comprising:

a) hydrotreating said initial feed under conditions which produce a product (P) containing 2 to 50 times less sulphur than the initial feed, said hydrotreatment being carried out at a partial pressure of hydrogen at the reactor outlet of about 0.5 MPa to about 5 MPa, such that the dearomatisation ratio of the feed is at most 30%, b) separating product (P) into a product (P2), with an initial boiling point which is greater than the boiling point of extraction solvent used in c), and a product (P1) with a final boiling point which is lower than the initial boiling point of product P2, c) liquid/liquid extracting product (P2) from b), at an extraction temperature of at most 140° C., under conditions which will extract polyaromatic compounds, using a solvent or solvent mixture (S1) to extract at least a portion of the polyaromatic compounds contained therein, said solvent having an initial boiling point which is lower than the initial boiling point of product (P2) from b), and recovering an extract (E1), which is enriched in polyaromatic compounds, and a raffinate (R1), d) separating solvent (S1) used in c) from raffinate (R1) produced in c), and recovering a product which is enriched in solvent (S1) and a product (Q1) which is depleted in solvent (S1) which has improved qualities and contains less than 500 ppm of sulphur, and e) removing a light fraction from at least a portion of product (P1) from b) to produce a fraction (F), and mixing fraction (F) with at least a portion of product (Q1) from d.

2. A process according to claim 1, wherein the hydrogen pressure at the reactor outlet is 1 to 5 MPa, such that the dearomatisation ratio of the feed is at most about 15%.

3. A process according to claim 1, wherein c) is carried out under conditions to produce a raffinate (R1) which contains at most 90% by weight of the total weight of aromatic hydrocarbons not containing a sulphur atom present in product (P2) obtained in step b).

4. A process according to claim 1, further comprising separating solvent (S1) from extract (E1) obtained from c) and recovering a product enriched in solvent (S1) and a bottom product (Q2) depleted in solvent (S1).

5. A process according to claim 4, further comprising introducing in hydrotreatment a), at least a portion of the bottom product (Q2) obtained from extract (E1) in c) after separation of solvent (S1), along with the hydrocarbon feed to be treated.

6. A process according to claim 4, further comprising hydrotreating bottom product (Q2) in a hydrotreatment zone which is separate from the hydrotreatment zone of a), under conditions which produce a product (P3) with a sulphur content which is less than or equal to 0.2% by weight.

7. A process according to claim 1, further comprising recycling the product enriched in solvent (S1) obtained by separation of the raffinate (R1) and optionally extract (E1) to liquid/liquid extraction c).

8. A process according to claim 1, wherein the solvent is methanol, acetonitrile, monomethylformamide, dimethylformamide, dimethylacetamide, furfural, N-methylpyrrolidone or dimethylsulphoxide.

9. A process according to claim 1, wherein the solvent is an oxygenated non nitrogen containing compound.

10. A process according to claim 1, wherein the feed contains 100 to 1,000 ppm nitrogen.

11. A process according to claim 1, wherein the solvent (S1) is furfural.

12. A process according to claim 1, wherein the hydrogen pressure at the reactor outlet is 0.5 to 3 MPa.

13. A process comprising distilling a hydrocarbon feed with an initial boiling point of at least 150° C. and a final boiling point of at most 500° C. in a distillation zone to produce an overhead fraction (F1) with a final boiling point of at least 250° C. and a bottom fraction (F2) with an initial boiling point of at least 250° C., treating said fraction (F2) in accordance with claim 1, and hydrotreating fraction (F1) in a hydrotreatment zone which is separate from that of a), recovering therefrom a hydrotreated product (P') and separating therefrom in a separation zone a fraction (P10) with a final boiling point of less than 150° C., and a fraction (P20) with an initial boiling point which is greater than the final boiling point of fraction (P10).

14. A process according to claim 13, wherein at least a portion of fraction (P20) is mixed with product (Q1) obtained from step d) or with a mixture of products (P1) and (Q1).

15. A process for the production of a base component for a compression ignition internal combustion engine fuel blend with an improved cetane index and sulphur content, from an initial hydrocarbon feed with an initial boiling point of at least 150° C. and a final boiling point of at most 500° C., containing about 0.05% to about 5% by weight of sulphur, about 10% to about 60% by weight of—and isoalkanes, about 10% to about 85% by weight of aromatic hydrocarbons at least partially in the form of polyaromatic compounds optionally containing sulphur, with a cetane index of about 20 to about 60 and a nitrogen content of about 50 to about 5000 ppm by weight, said process comprising:

a) distilling said hydrocarbon feed with an initial boiling point of at least 150° C. and a final boiling point of at most 500° C. in a distillation zone to produce an overhead fraction (F1) with a final boiling point of at least 250° C. and a bottom fraction (F2) with an initial boiling point of at least 250° C., b) hydrotreating fraction (F2) under conditions which produce a product (P) containing 2 to 50 times less sulphur than the initial feed, said hydrotreatment being carried out at a partial pressure of hydrogen at the reactor outlet of about 0.5 MPa to about 5 MPa, such that the dearomatisation ratio of the feed is at most 30%, c) separating product (P) into a product (P2), with an initial boiling point which is greater than the boiling point of extraction solvent used in d), and a product (P1) with a final boiling point which is lower than the initial boiling point of product P2, d) liquid/liquid extracting product (P2) from step c), at an extraction temperature of at most 140° C., under conditions which will extract polyaromatic compounds, using a solvent or solvent mixture (S1) to extract at least a portion of the polyaromatic compounds contained therein, said solvent having an initial boiling point which is lower than the initial boiling point of product (P2) from step c), and recovering an extract (E1), which is enriched in polyaromatic compounds, and a raffinate (R1), and e) separating solvent (S1) used in step c) from raffinate (R1) produced in step c), and recovering a product which is enriched in solvent (S1) and a product (Q1) which is depleted in solvent (S1) which has improved qualities and contains less than 500 ppm of sulphur, f) separating solvent (S1) from extract (E1) obtained from d) and recovering a product enriched in solvent (S1) and a bottom product (Q2) depleted in solvent (S1), g) hydrotreating fraction (F1) in a hydrotreatment zone which is separate from that of b), recovering therefrom a-hydrotreated product (P') and separating therefrom in a separation zone a fraction (P10) with a final boiling point of less than 150° C., and a fraction (P20) with an initial boiling point which is greater than the final boiling point of fraction (P10), and h) removing a light fraction from at least a portion of product (P1) from b) to produce a fraction (F), and mixing fraction (F) with at least a portion of product (Q1) from d.

16. A process according to claim 15, further comprising hydrotreating the entirety of bottom product (Q2) in a hydrotreatment zone which is optionally separate from the hydrotreatment zone of a), under conditions which produce a product (P3) with a sulphur content which is less than or equal to 0.3% by weight.

17. A process for the production of a base component for a compression ignition internal combustion engine fuel blend with an improved cetane index and sulphur content, from an initial hydrocarbon feed with an initial boiling point of at least 150° C. and a final boiling point of at most 500° C., containing about 0.05% to about 5% by weight of sulphur, about 10% to about 60% by weight of—and isoalkanes, about 10% to about 85% by weight of aromatic hydrocarbons at least partially in the form of polyaromatic compounds optionally containing sulphur, with a cetane index of about 20 to about 60 and a nitrogen content of about 50 to about 5000 ppm by weight, said process comprising:

a) distilling said hydrocarbon feed with an initial boiling point of at least 150° C. and a final boiling point of at most 500° C. in a distillation zone to produce an overhead fraction (F1) with a final boiling point of at least 250° C. and a bottom fraction (F2) with an initial boiling point of at least 250° C., b) hydrotreating fraction (F2) under conditions which produce a product (P) containing 2 to 50 times less sulphur than the initial feed, said hydrotreatment being carried out at a partial pressure of hydrogen at the reactor outlet of about 0.5 MPa to about 5 MPa, such that the dearomatisation ratio of the feed is at most 30%, c) separating product (P) into a product (P2), with an initial boiling point which is greater than the boiling point of extraction solvent used in d), and a product (P1) with a final boiling point which is lower than the initial boiling point of product P2, d) liquid/liquid extracting product (P2) from c), at an extraction temperature of at most 140° C., under conditions which will extract polyaromatic compounds, using a solvent or solvent mixture (S1) to extract at least a portion of the polyaromatic compounds contained therein, said solvent having an initial boiling point which is lower than the initial boiling point of product (P2) from c), and recovering an extract (E1), which is enriched in polyaromatic compounds, and a raffinate (R1), and e) removing a light fraction from at least a portion of product (P1) from c) to produce a fraction (F), and mixing fraction (F) with at least a portion of product (Q1) from f), f) separating solvent (S1) used in d) from raffinate (R1) produced in d), and recovering a product which is enriched in solvent (S1) and a product (Q1) which is depleted in solvent (S1) which has improved qualities and contains less than 500 ppm of sulphur, g) separating solvent (S1) from extract (E1) obtained from d) and recovering a product enriched in solvent (S1) and a bottom product (Q2) depleted in solvent (S1), h) hydrotreating the entirety of bottom product (Q2) in a hydrotreatment zone which is optionally separate from the hydrotreatment zone of a), under conditions which produce a product (P3) with a sulphur content which is less than or equal to 0.3% by weight, and i) hydrotreating fraction (F1) in a hydrotreatment zone which is separate from that of b), recovering therefrom a hydrotreated product (P') and separating therefrom in a separation zone a fraction (P10) with a final boiling point of less than 150° C., and a fraction (P20) with an initial boiling point which is greater than the final boiling point of fraction (P10).

* * * * *